US006292570B1

(12) United States Patent
Aarts

(10) Patent No.: US 6,292,570 B1
(45) Date of Patent: Sep. 18, 2001

(54) SURROUND SOUND

(75) Inventor: Ronaldus M. Aarts, Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/247,757

(22) Filed: Feb. 9, 1999

(30) Foreign Application Priority Data

Feb. 13, 1998 (EP) ..... 98200448

(51) Int. Cl.[7] ..... H04R 5/00
(52) U.S. Cl. ..... 381/18; 381/1; 381/17
(58) Field of Search ..... 381/1, 17, 18, 381/19, 20, 22, 23, 98, 99, 63

(56) References Cited

U.S. PATENT DOCUMENTS 4,933,768 * 6/1990 Ishikawa et al. ..... 381/18
5,546,465 * 8/1996 Kim ..... 381/18
5,579,396 * 11/1996 Iida et al. ..... 381/18
5,604,809 * 2/1997 Tsubonuma et al. ..... 381/1
5,761,315 6/1998 Iida et al. ..... 381/18
5,799,094 * 8/1998 Mouri ..... 381/18
5,844,993 * 12/1998 Iida et al. ..... 381/17
6,122,382 * 9/2000 Iida et al. ..... 381/18

FOREIGN PATENT DOCUMENTS

0637191A2 2/1995 (EP) ..... H04S/1/00
0724378A2 7/1996 (EP) .

* cited by examiner

*Primary Examiner*—Minsun Oh Harvey
*Assistant Examiner*—Xu Mei
(74) *Attorney, Agent, or Firm*—Edward W. Goodman

(57) ABSTRACT

To improve listener perceived characteristics multi-channel sound reproduction systems are known which include a surround sound channel. It is preferred to reproduce the surround sound signal without having rear loudspeakers, so using the front stereophonic loudspeakers. To improve the surround sound, the frequency range of the surround sound signal is divided in at least two adjacent frequency bands. After division, the two parts of the surround signal are expanded to further improve the reproduced surround signal. At last, the expanded surround signals are combined with the respective stereophonic signals.

9 Claims, 4 Drawing Sheets

SURROUND SOUND

BACKGROUND OF THE INVENTION

1. Field of The Invention

The invention relates to a sound reproduction system comprising a left channel and a right channel loudspeaker, a surround decoder unit for decoding at least one input signal into at least one rear surround signal and two channel stereophonic signals, a surround signal processing unit for converting the rear surround signal(s) into a first and a second surround signal and for localizing these surround signals at virtual sound sources located away from the left channel and the right channel loudspeakers, and first combining means coupled to one of the loudspeakers for combining the first surround signal with one of the stereophonic signals, and second combining means coupled to the other loudspeaker for combining the second surround signal with the other stereophonic signal, and the surround signal processing unit further comprises filter means.

The invention further relates to a surround signal processing unit.

The invention further relates to a sound/visual reproduction system comprising a sound reproduction system.

The invention further relates to a method for processing an input surround sound signal.

2. Description of The Related Art

To improve listener perceived characteristics, multichannel sound reproduction systems are known which include a surround-sound channel (often referred to in the past as an "ambience" or "special-effects" channel) in addition to left and right (and optimally, center) sound channels. These systems are now relatively common in motion picture theatres and are becoming more and more common in the homes of the customers. A driving force behind the proliferation of such systems in consumers' homes is the widespread availability of surround-sound home video software, mainly surround-sound motion pictures (movies) made for theatrical release and subsequently transferred to home video media (e.g., videocassettes, videodisks, and broadcast or cable television).

Although home video media have two-channel stereophonic soundtracks, those two channels carry, by means of amplitude and phase matrix encoding, four channels of sound information, i.e., left, center, right and surround sound, usually identical to the two-channel stereophonic motion-pictures soundtracks from which the home video soundtracks are derived. As is also done in the motion picture theatre, the left, center, right, and surround channels are decoded and recovered by consumers with a matrix decoder, usually referred to as a "surround-sound" decoder. In the home environment, the decoder is usually incorporated in, or is an accessory to a videocassette player, videodisk player, or television set/video monitor.

In the case where stereophonic sound is reproduced in such a way as to provide a sound field expanding behind a listener or to localize a sound image behind a listener, two (front) loudspeakers are arranged in front of a listener for stereophonic sound reproduction and at least one or two rear loudspeakers are additionally arranged behind the listener for surround reproduction.

In the ordinary homes, however, since it is difficult to arrange the two rear loudspeakers and the center loudspeaker from the standpoint of space and cost, in practice, only L- and R-channel loudspeakers are installed on the front left and right sides of a listener. In this loudspeaker arrangement, it has become impossible to obtain sufficient surround sound effect. In the case of the sound reproduction system using a monophonic surround signal in particular, although this system has such a feature that a sound field can be obtained on the rear side of a listener or the sound image can be shifted, it has been impossible to obtain such effects as described above without arranging the rear loudspeakers.

To solve the above problem, it is known from the European Patent Application EP-A-0637191, corresponding to U.S. Pat. Nos. 5,579,396 and 5,761,315, to use a surround signal processing unit (apparatus) whereby a stereophonic sound effect, similar to the case where the rear loudspeakers are arranged, can be obtained on the basis of the sound reproduction through only the front left and right loudspeakers.

The inputted rear surround signal is processed by filter means and the processed signal is added to one of the stereophonic signals and then outputted to one of the pair of the loudspeakers. Further an inversion signal of the filter processed signal is added to the other of the stereophonic signals and then outputted to the other of the loudspeakers.

A disadvantage of this known sound reproduction system is that the perceived sound depends strongly on the position (of the head of the listener and) of the listener. Further, the filter characteristics are complex and dependent on the listener, for example, of the rear canal, head/torso, and/or pinna, resulting in possible failures of the requested results. Further, this known sound reproduction system is complex.

SUMMARY OF THE INVENTION

It is an object of the present invention to provide a sound reproduction system that does not have the drawbacks of the sound reproduction system as described above and, further, to provide a robust sound reproduction system whereby the operation of the filter topology is very robust against coefficient quantization. Further, the listeners position will be less relevant for the performance of the sound reproduction system.

To this end, a first aspect of the invention provides a sound reproduction system as described above, characterized in that the filter means of the surround signal processing unit comprises dividing means for dividing at least one predetermined frequency range of the rear surround signal(s) into at least two adjacent frequency bands, supplying a first selection of frequency bands as the first surround signal to the first combining means and a second selection of frequency bands as the second surround signal to the second combining means, the first and second selections being substantially disjunct, a sum of the first and second selections covering the predetermined frequency range.

By splitting the frequency range of the rear surround sound in disjunct frequency bands and supplying a first selection to the left loudspeaker and a second selection to the right loudspeaker, the spectrum has been widened resulting in a perceived surround sound.

It is to be noted that when the input signal is, for example, a MPEG signal having a stereophonic surround sound signal, the surround signal processing unit only has to localize these stereophonic surround signal at virtual sound sources located away from the left channel and right channel loudspeakers and no decoding into a first (for example, left) and second (for example, right) surround signal is necessary.

A second aspect of the invention provides a sound/visual reproduction system comprising such a sound reproduction system.

The use of the sound reproduction system in a sound/visual reproduction system, such as a television receiver, computer monitor, etc., enhances the reproduced sound considerable, resulting in a greatly improved customer satisfaction.

A third aspect of the invention provides a surround signal processing unit as used in the above-described sound reproduction system.

Such a surround signal processing unit can be used not only by a sound reproduction system and a sound/visual reproduction system, such as a television set, but also, for example, in computer sound cards and/or computer (sound) games.

A fourth aspect of the invention provides a method for processing an input surround sound signal into a left and a right channel output signal, characterized in that the method comprises the steps of dividing a predetermined frequency range of the input surround sound signal into at least two adjacent frequency bands, supplying a first selection of frequency band(s) to form after expanding the left channel output signal, supplying a second selection of frequency band(s) to form after expanding the right channel output signal, the first and second selections being substantially disjunct, a sum of the first and second selections covering the predetermined frequency range.

By splitting the frequency range of the surround sound signal into at least two frequency bands, and expanding the signals to be supplied to, respectively, the left and right loudspeakers, an improved surround sound is obtained.

A sound reproduction system according to the invention provides an efficient implementation of the so-called incredible surround sound whereby the filter topology is such that the filter coefficients are more robust against quantization and require less storage. This is achieved by splitting the frequency range in disjunct frequency bands.

A preferred embodiment of a sound reproduction system according to the invention has the features that the surround signal processing unit comprises an all-pass filter, the output of this all-pass filter is coupled, via a second filter, to an input of a de-shuffler, the other input of the de-shuffler being coupled, via a second filter, to the input of the surround signal processing unit.

In this way, a very simplified sound reproduction system is obtained having the preferred performances.

An embodiment of a sound reproduction system according to the invention has the features that the surround decoder also provides a center signal having a first and a second part, whereby the first part is supplied via a first scaler to the first combining means, and the second part is supplied via a second scaler to the second combining means.

In case no center loudspeaker is present, the center signal is split in a left and a right part, each part can be supplied, multiplied by relevant factors when necessary via the respective combining means, to the respective left and right loudspeaker.

BRIEF DESCRIPTION OF THE DRAWINGS

These and other aspects of the invention will be apparent from and elucidated by the following figures, in which.

DESCRIPTION OF THE PREFERRED EMBODIMENTS

Figure 1:
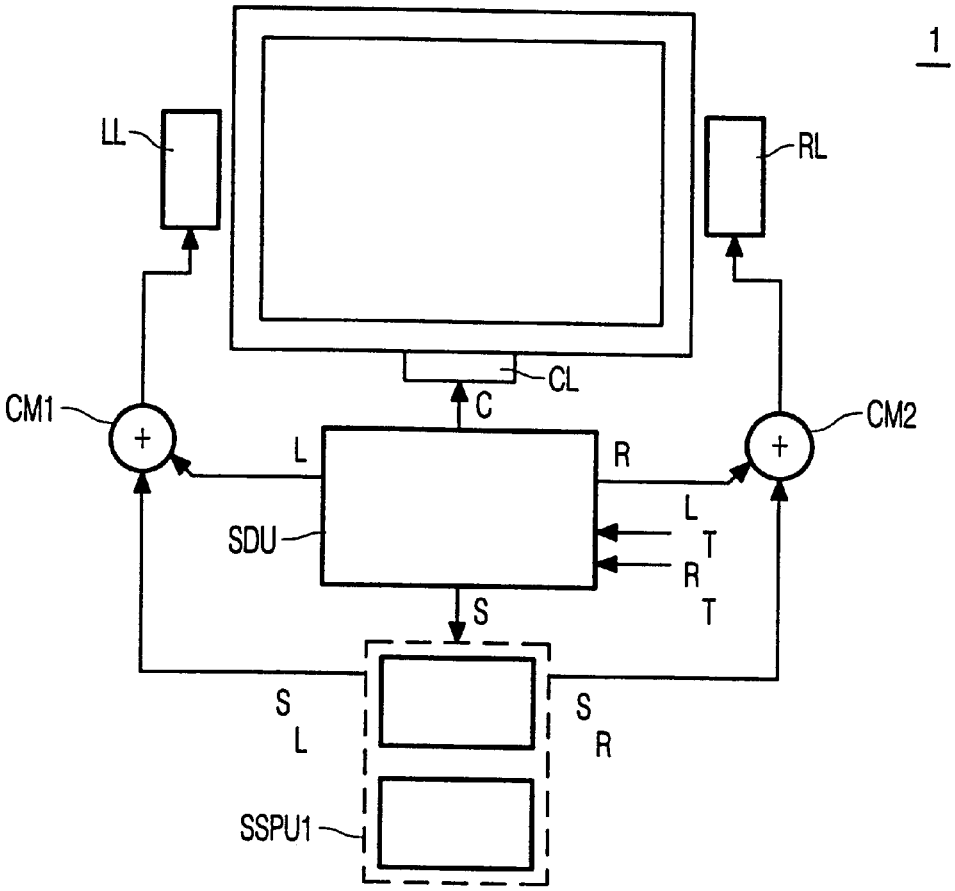
FIG. 1 is a block schematic diagram of a sound/visual reproduction system.

FIG. 1 shows a sound/visual reproduction system 1, such as a television set, comprising a left channel loudspeaker LL and a right channel loudspeaker RL and a center loudspeaker CL. The sound/visual reproduction system further comprises a surround decoder unit SDU for decoding an input signal comprising two components LT and RT into a rear surround signal S and two channel front stereophonic signals L and R and a center signal C. Further the sound/visual reproduction system comprises a surround signal processing unit SSPU1 for converting the rear surround signal S, in the absence of a rear loudspeaker, into a first and a second surround signal SL and SR and for localizing these surround signals at virtual sound sources located away from the left channel and right channel loudspeakers LL and RL. The first stereophonic signal L is combined with the first surround signal SL in first combining means CM1 and the second stereophonic signal R is combined with the second surround signal SR in second combining means CM2. The output of the first combining means is coupled to the left loudspeaker LL and the output of the second combining means is coupled to the right loudspeaker RL.

The surround signal processing unit SSPU1 comprises filter means which includes means for dividing a predetermined frequency range of the rear surround signal into at least two adjacent frequency bands, and for supplying a first selection of the frequency bands as the first surround signal to the first combining means CM1 and a second selection of the frequency bands to the second combining means CM2. The first and second selections being substantially disjunct and the sum of the first and second selections covers the predetermined frequency range.

Figure 2:
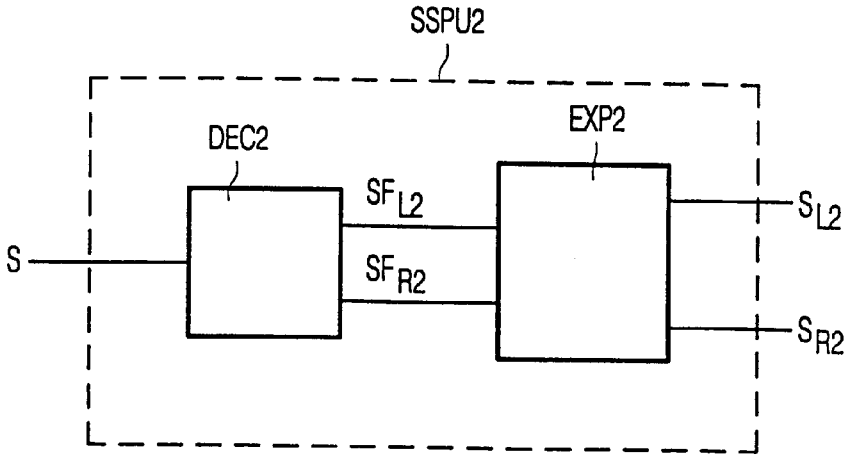
FIG. 2 is a block schematic diagram of a surround signal processing unit.

In FIG. 2, a surround signal processing unit is shown in block schematic form according to the invention. Embodiments of the surround signal processing unit will be described below with reference to FIGS. 3, 5 and 7.

Instead of using the center loudspeaker CL, it is also possible, in case no center loudspeaker is present, to split the center signal in two parts, these parts being supplied via (amended) combining means to, respectively, the left and right loudspeakers LL and RL.

FIG. 2 shows a block schematic diagram of a surround signal processing unit SSPU2 according to the invention, wherein a received surround signal is transferred into two de-correlated signals SFL2 and SFR2 by a de-correlator DEC2. To further improve the surround sound, the signals SFL2 and SFR2 are supplied to an expander EXP2 to widen the signals. The surround signal processing unit supplies, at outputs, a left surround signal SL2 and a right surround signal SR2. These output signals can be supplied to the first and second combining means (see FIG. 1), to be finally supplied to the left and right loudspeakers.

When the input signal is a MPEG-signal a stereophonic surround signal is available. As a consequence, no de-correlation is necessary.

Figure 5:
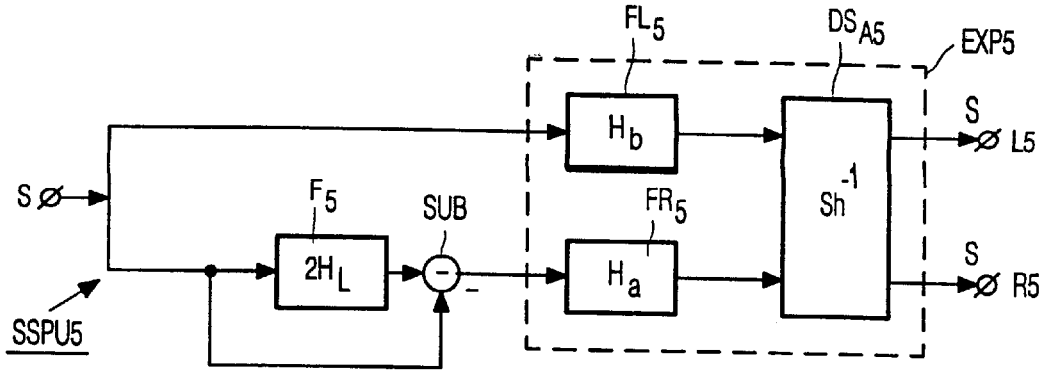
FIG. 5 is a block schematic diagram of a second embodiment of the surround signal processing unit according to the invention.
Figure 7:
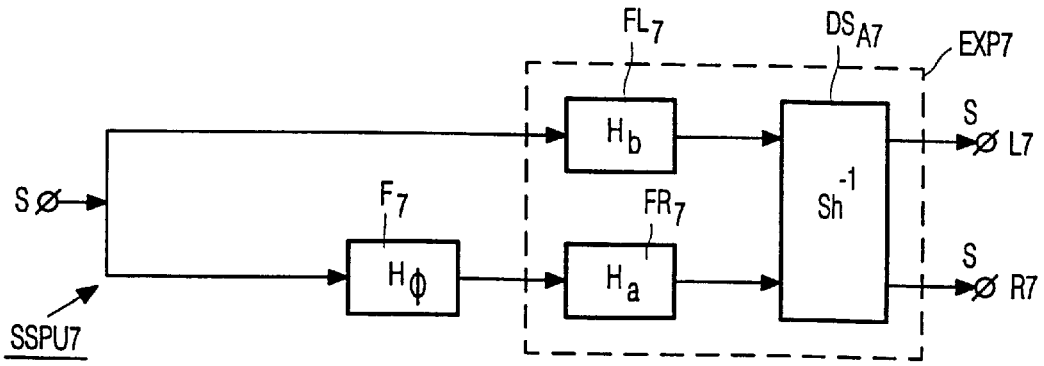
FIG. 7 is a block schematic diagram of a third embodiment of the surround signal processing unit according to the invention.

The expanding (widening) of the surround signals SFL2 and SFR2 can be done in a lot of ways. In the following embodiment (FIG. 3), a shuffler, filtering with filter transfer functions Ha, Hb, and a de-shuffler is used which is a very efficient way to perform the expanding of the surround signal. In FIGS. 5 and 7, the expanders EXP5 and EXP7, respectively, have been further optimized by minimizing the elements which are necessary.

Figure 3:
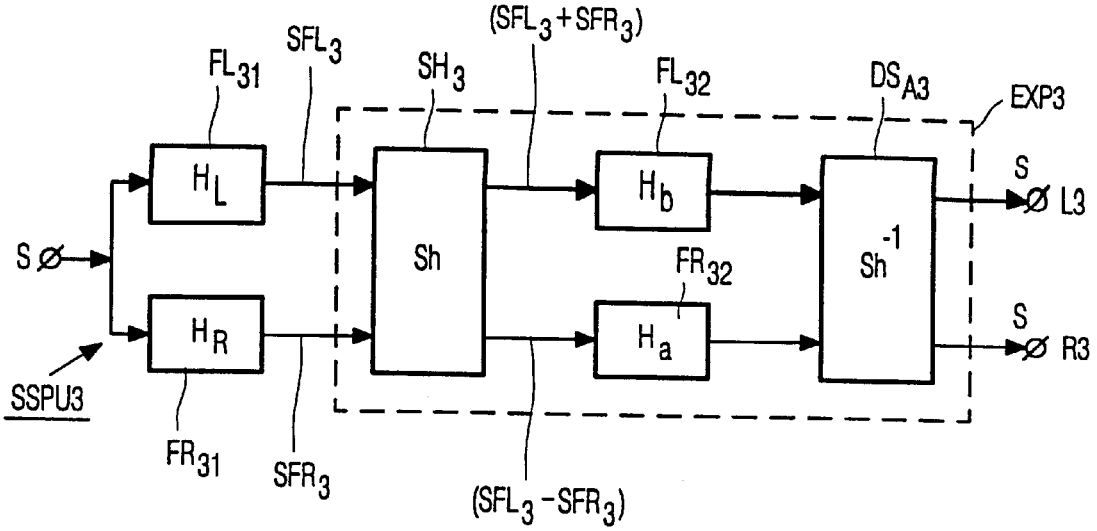
FIG. 3 is a block schematic diagram of a first embodiment of a surround signal processing unit according to the invention.
Figure 4A:
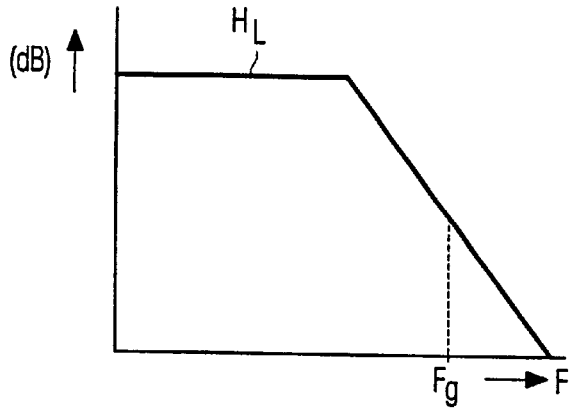
FIGS. 4*a* and 4*b* show frequency response curves of the de-correlation filters of FIG. 3.
Figure 4B:
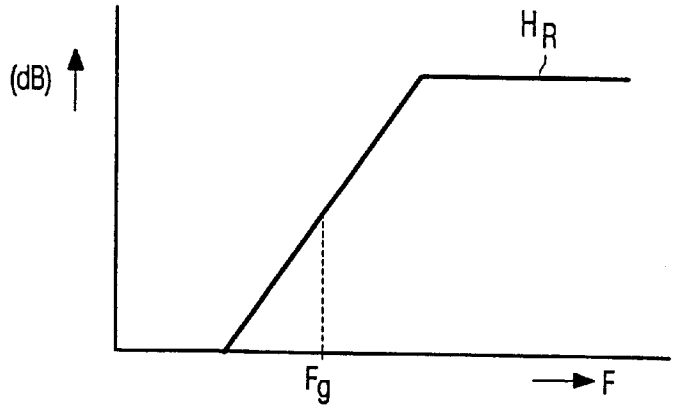

FIG. 3 shows a first embodiment of a surround signal processing unit SSPU3 receiving the surround signal S which is supplied to a first de-correlation filter FL31 having a transfer function HL as shown in FIG. 4*a*, and a second de-correlation filter FR31 having a transfer function HR shown in FIG. 4*b*. The de-correlation filters FL31 and FR31 operate as dividing means to divide the frequency range of the surround signal into disjunct parts. The output signals of the filters FL3 and FR3 are supplied to a so-called shuffler SH3 of an expander EXP3. This shuffler calculates a sum-signal (SFL3+SFR3) and a difference-signal (SFL3−SFR3). The sum-signal and difference-signal are supplied, via, respectively, a filter FL32 with a transfer function Hb (see FIG. 9) and a filter FR32 with a transfer function Ha (see FIG. 9), to a so-called de-shuffler DSH3. At the outputs of the de-shuffler, the first and second surround sound signals SL3 and SR3 are obtained, to be supplied to the combining means CM1 and CM2 (see FIG. 1).

The use of a shuffler together with the filters having transfer functions Ha, Hb, respectively, and a de-shuffler, is a preferred embodiment of the expander to widen (expand) the surround sound signals.

FIGS. 4*a* and 4*b* show the most elementary solution to divide the frequency range in two disjunct bands by using a low-pass filter for the first filter FL31 (FIG. 4*a*) and a high-pass filter for the second filter FR31 (FIG. 4*b*). In this way, the lower half (below the frequency Fg) of the frequency range of the rear surround signal S will be supplied to the left loudspeaker LL and the upper half of the frequency range (above the frequency Fg) to the right loudspeaker RL.

FIG. 5 shows a second embodiment of a surround signal processing unit SSPU5 receiving the surround signal S from the surround decoder (see FIG. 1). A simplification has been made by deriving the filter FR31 from the filter FL31 (see FIG. 3) by using the relation in transfer function HR=1−HL. It is to be noticed that it is also possible to use HL=1−HR. Using this simplification, the scheme of the surround signal processing unit can be simplified as shown in FIG. 5. In this example, the surround signal S is supplied to a filter F5 having a transfer function of 2HL, the output signal of this filter being supplied to a positive input of a subtract-unit SUB, which receives at the negative input the signal S resulting in a total transfer function (2HL−1). The subtract-unit SUB supplies, at the output, a difference signal which is supplied, via a filter FR5 with a transfer function Hb (see FIG. 9), to a de-shuffler DSH5. At the other input, the de-shuffler receives the signal S via a filter FL5 with a transfer function Ha (see FIG. 9).

Figure 6:
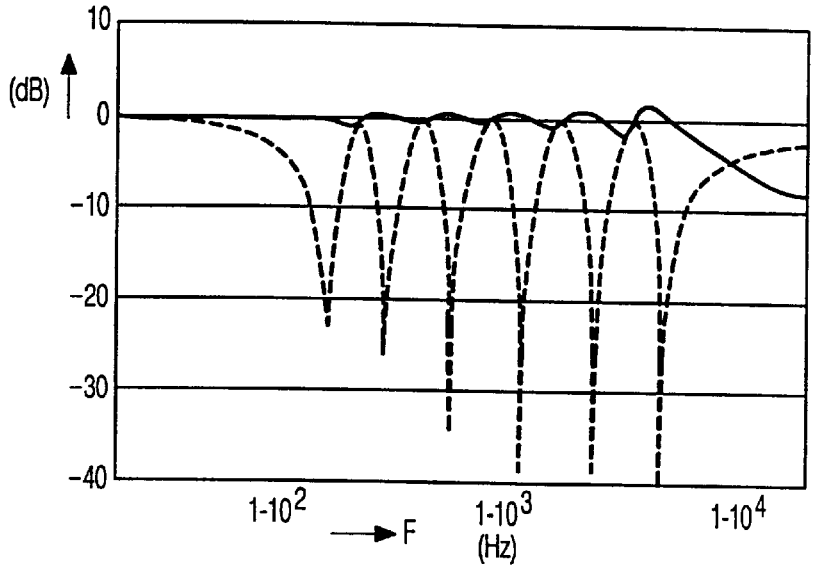
FIG. 6 shows a frequency response curve of the filter transfer functions HL and 2HL-1 of FIG. 5.

FIG. 6 shows the transfer function of amplitude-versus-frequency for HL (dashed line) and (2HL−1) (solid line). It is clear to see that certain frequency bands will be passed on to the left loudspeaker and other frequency bands to the right loudspeaker.

Figure 8:
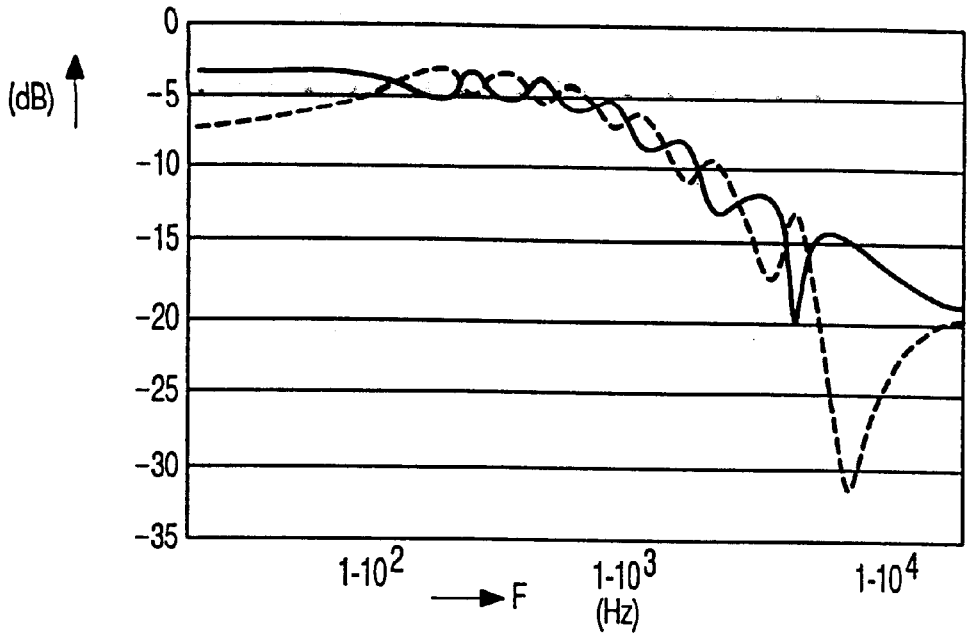
FIG. 8 shows a frequency response curve of the surround signal processing unit of FIG. 7.

FIG. 7 shows a preferred embodiment of a surround signal processing unit SSPU7 receiving the signal S from the surround decoder (see FIG. 1). The filter F5 and the subtract-unit SUB from FIG. 5 are replaced by an all-pass filter F7 having a transfer function HΦ. In FIG. 8, the total transfer function of amplitude versus frequency is shown for the example of FIG. 7. A de-shuffler DSH7 receives, at one input, the signal S via the filter F7 and the filter FR7. At the other input, the de-shuffler receives, via a filter FL7, the signal S. The de-shuffler supplies the sig n als SL7 and SR7 which can be supplied to the combining means (see FIG. 1).

FIG. 8 shows the total transfer function from the surround sound signal S to the signals SL (solid line) and SR (dashed line). Peaks in one curve coincide with dips in the other curve.

Figure 9:
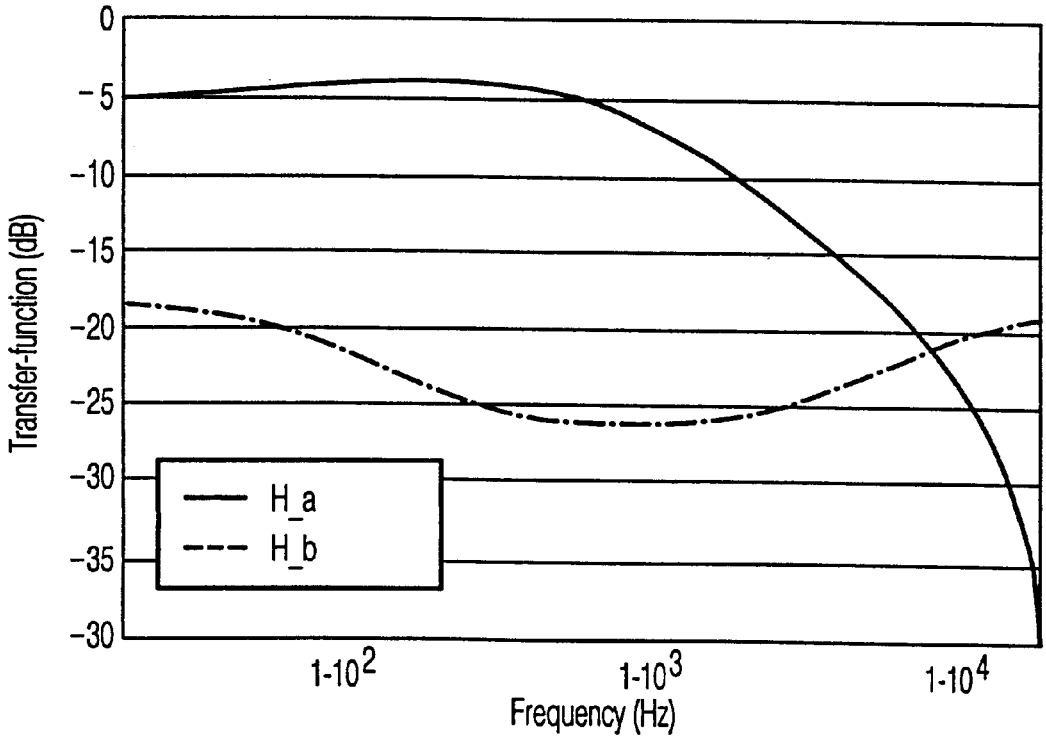
FIG. 9 shows a frequency response curve of the filter transfer functions Ha and Hb.

FIG. 9 shows the transfer functions Ha (solid line) and Hb (dashed line) as used in the filters FL32, FR32, FL5, FR5, and FL7, FR7.

The skilled man in the art will realize that a lot of variations are possible without departing from the invention. So is it possible, as mentioned above, to amend the combining means to combine also a split center signal CL an d CR in case no center loudspeaker is present.

The s urround signal processing unit according to the invention can be used not only in a sound reproduction system, and/or a sound/visual reproduction system such as a television set, but, for example, also in a computer sound card and/or in computer (sound) games, multi media sets, portable audio equipment etc. It will be further evident that the filters may be implemented analog or digital. The order of the filters may be chosen at will, although second-order filters have proven to perform satisfactory.

Further, as mentioned above, when the input signal of the sound/visual reproduction system is a MPEG signal, no de-correlation is necessary.

Instead of using the shuffler, filtering and de-shuffler combination, whether or not optimized, as an expander to provide a widening of the surround signals, the man skilled in the art is well aware of other ways.

By splitting the surround signal into two disjunct selections and by widening (expanding) these selections, the reproduced surround sound is enhanced considerably.

What is claimed is:

1. A sound reproduction system comprising:

a left channel and a right channel loudspeaker;

a surround decoder unit for decoding at least one input signal into at least one rear surround signal and two channel stereophonic signals;

a surround signal processing unit for converting the at least one rear surround signal into a first and a second surround signal, and for localizing the first and second surround signals at virtual sound sources located away from the left channel loudspeaker and the right channel loudspeaker;

first combining means coupled to one of the left and right channel loudspeakers for combining the first surround signal with one of the stereophonic signals; and second combining means coupled to the other one of the left and right channel loudspeakers for combining the second surround signal with the other stereophonic signal, wherein the surround signal processing unit comprises filter means, characterized in that the filter means of the surround signal processing unit comprises:

dividing means for dividing at least one predetermined frequency range of the at least one rear surround signal into at least two adjacent frequency bands, said dividing means supplying a first selection of said two adjacent frequency bands as the first surround signal to the first combining means, and a second selection of said two adjacent frequency bands as the second surround signal to the second combining means, wherein the first and second selections are substantially disjunct, in which a sum of the first and second selections covers the predetermined frequency range.

2. The sound reproduction system as claimed in claim 1, characterized in that the dividing means alternately supplies consecutive frequency bands as the first and second surround signals.

3. The sound reproduction system as claimed in claim 1, characterized in that the filter means comprises a first de-correlation filter and a second de-correlation filter, and said surround signal processing unit further comprises:

a shuffler having inputs coupled, respectively, to outputs of said first and second de-correlation filters;

a third and a fourth filter having inputs coupled, respectively, to outputs of the shuffler; and a de-shuffler having inputs coupled, respectively, to outputs of the third and fourth filters for expanding the surround signals.

4. The sound reproduction system as claimed in claim 1, characterized in that the filter means comprises a first filter, and the surround signal processing unit further comprises:

an input coupled to an input of said first filter;

a subtract unit having a first input coupled to the input of said surround signal processing unit, and a second input coupled to an output of the first filter;

a second filter having an input coupled to an output of the subtract unit, and a third filter having an input coupled to the input of said surround signal processing unit; and a de-shuffler having inputs coupled, respectively, to outputs of said second and third filters.

5. The sound reproduction system as claimed in claim 1, characterized in that said filter means comprises an all-pass filter, and the surround signal processing unit further comprises:

an input coupled to an input of said all-pass filter;

a first filter having an input coupled to an output of said all-pass filter, and a second filter having an input coupled to the input of said surround signal processing unit; and a de-shuffler having inputs coupled, respectively, to outputs of said first and second filters.

6. The sound reproduction system as claimed in claim 1, characterized in that the surround decoder unit also provides a center signal having a first part and a second part, said surround decoder unit comprising a first scaler having an input for receiving the first part, and a second scaler having an input for receiving the second part, said first and second scalers adjusting an amplitude of said first and second parts, respectively, an output of said first scaler being coupled to the first combining means, and an output of said second scaler being coupled to the second combining means.

7. A sound/visual reproduction system comprising a sound reproduction system as claimed in claim 1.

8. A surround signal processing unit for converting at least one rear surround signal into a first and a second surround signal, and for localizing the first and second surround signals at virtual sound sources located away from a left channel loudspeaker and a right channel loudspeaker, said surround signal processing unit including filter means comprising dividing means for dividing at least one predetermined frequency range of the at least one rear surround signal into at least two adjacent frequency bands, said dividing means supplying a first selection of said two adjacent frequency bands as the first surround signal to first combining means, and a second selection of said two adjacent frequency bands as the second surround signal to second combining means, said first and second combining means enabling the first and second surround signals to be combined with left and right channel stereo signals, respectively, wherein the first and second selections are substantially disjunct, in which a sum of the first and second selections covers the predetermined frequency range.

9. A method for processing an input surround signal into a left and a right channel output signal, characterized in that the method comprises the steps:

dividing a predetermined frequency range of the input surround sound signal into at least two adjacent frequency bands;

expanding the surround sound signal in one of said adjacent frequency bands to form the left channel output signal; and expanding the surround sound signal in the other one of said adjacent frequency bands to form the right channel output signal, wherein the at least two adjacent frequency bands are substantially disjunct, in which a sum of the surround sound signals in said at least two frequency bands covers the predetermined frequency range.

* * * * *